United States Patent [19]

Ericson et al.

[11] 4,009,815

[45] Mar. 1, 1977

[54] APPARATUS FOR MAINTAINING VERTICALLY MOVING STRIP AT ESTABLISHED TENSION

[75] Inventors: Ivan Leo Ericson, Towanda; James Elroy Morean, Coudersport, both of Pa.

[73] Assignee: GTE Sylvania Incorporated, Stamford, Conn.

[22] Filed: Apr. 2, 1976

[21] Appl. No.: 672,850

[52] U.S. Cl. ..... 226/113; 226/119; 226/195

[51] Int. Cl.[2] ..... B65H 17/42

[58] Field of Search ..... 226/113, 118, 119, 195, 226/38, 39

[56] References Cited

UNITED STATES PATENTS

| | | | |
|---|---|---|---|
| 3,385,745 | 5/1968 | Mears | 156/345 |
| 3,589,581 | 6/1971 | Swindells | 226/119 |
| 3,883,389 | 5/1975 | Schott | 226/113 X |
| 3,942,190 | 3/1976 | Detwiler | 226/113 X |

*Primary Examiner*—Richard A. Schacher
*Attorney, Agent, or Firm*—Norman J. O'Malley; Lawrence R. Fraley; Donald R. Castle

[57] ABSTRACT

An apparatus for maintaining a vertically-oriented moving strip of thin and flexible metallic material at an established degree of tension in order to prevent deformation of the strip. The apparatus includes first and second series of vertically oriented rollers which extend above the apparatus's motion means to engage the strip during the strip's circuitous movement therebetween.

7 Claims, 6 Drawing Figures

APPARATUS FOR MAINTAINING VERTICALLY MOVING STRIP AT ESTABLISHED TENSION

BACKGROUND OF THE INVENTION

The invention relates to strip tensioning apparatus and more particularly to apparatus for maintaining moving vertically-oriented strips at an established tension to prevent deformation thereof.

Even more particularly, the invention relates to such apparatus wherein the strip is metallic and relatively thin and flexible, such as metallic strip used in the production of aperture masks for color television cathode ray tubes.

The manufacture of aperture masks of the nature described usually involves a continuous process wherein a relatively long strip of metallic material is passed through a plurality of processing operations whereby the material is cleaned, coated with a photoresist material, exposed to a desired pattern, developed, etched, and the individual masks removed therefrom. A typical thickness for aperture mask metal is approximately 0.006 inch, with many of the individual masks on a typical strip having a diagonal dimension exceeding 23 inches. As can be appreciated, this material in strip form is relatively flexible thus making it imperative during the above-described processes that the strip not be permitted to flex or similarly deform. Accordingly, it is essential that the strip be continuously maintained at a desired degree of tension in order to prohibit such deformation.

Prior art devices which maintained a satisfactory degree of tension on a moving vertically-oriented metallic strip have required positioning of the device's motion apparatus above the strip. It was considered necessary to position these components in said manner to accomplish the tension. In the production of color television aperture masks, a typical pulling force of 1,000 pounds is exerted on a strip typically 26 inches wide and 0.006 inch thick, thus requiring a relatively heavy-duty tensioning apparatus.

A preferred location for tensioning apparatus for use in processing aperture mask strip is between the photoresist coating operation and the exposure station on the mask line. On many occasions, contaminants such as oil, grease, etc. spilled from the device's drive and gear mechanisms located above the coated strip. As a result, said contaminants formed on the phtosensitive material coating and were subsequently passed into the exposure station. These contaminants adversely affected the exposure operation with the result being the necessary rejection of several masks.

It is believed therefore that an apparatus which maintains a vertically oriented moving strip of relatively thin and flexible metallic material at an established tension in addition to preventing deformation and contamination thereof would constitute an advancement in the art.

OBJECTS AND SUMMARY OF THE INVENTION

It is therefore a primary object of this invention to obviate the known disadvantages of prior art strip tensioning devices thus providing a means whereby a moving flexible metallic strip can be maintained at a specified tension without deformation and contamination thereof.

In accordance with one aspect of the invention, there is provided an apparatus for maintaining a vertically oriented moving metallic strip at an established tension. The apparatus comprises a frame, a movable carriage for moving between the upright members of the frame in a reciprocative manner, first and second guide means for guiding said movable carriage during this movement, first and second series of vertically oriented rollers for engaging the moving metallic strip to effect circuitous movement of the metallic strip therebetween, and motion means located below the rollers for imparting a motion to the carriage to accomplish the reciprocative movement and maintain the strip at the desired tension.

DESCRIPTION OF THE PREFERRED EMBODIMENTS

For a better understanding of the present invention, together with other and further objects, advantages and capabilities thereof, reference is made to the following disclosure and appended claims in connection with the above-described drawings.

Figure 1:
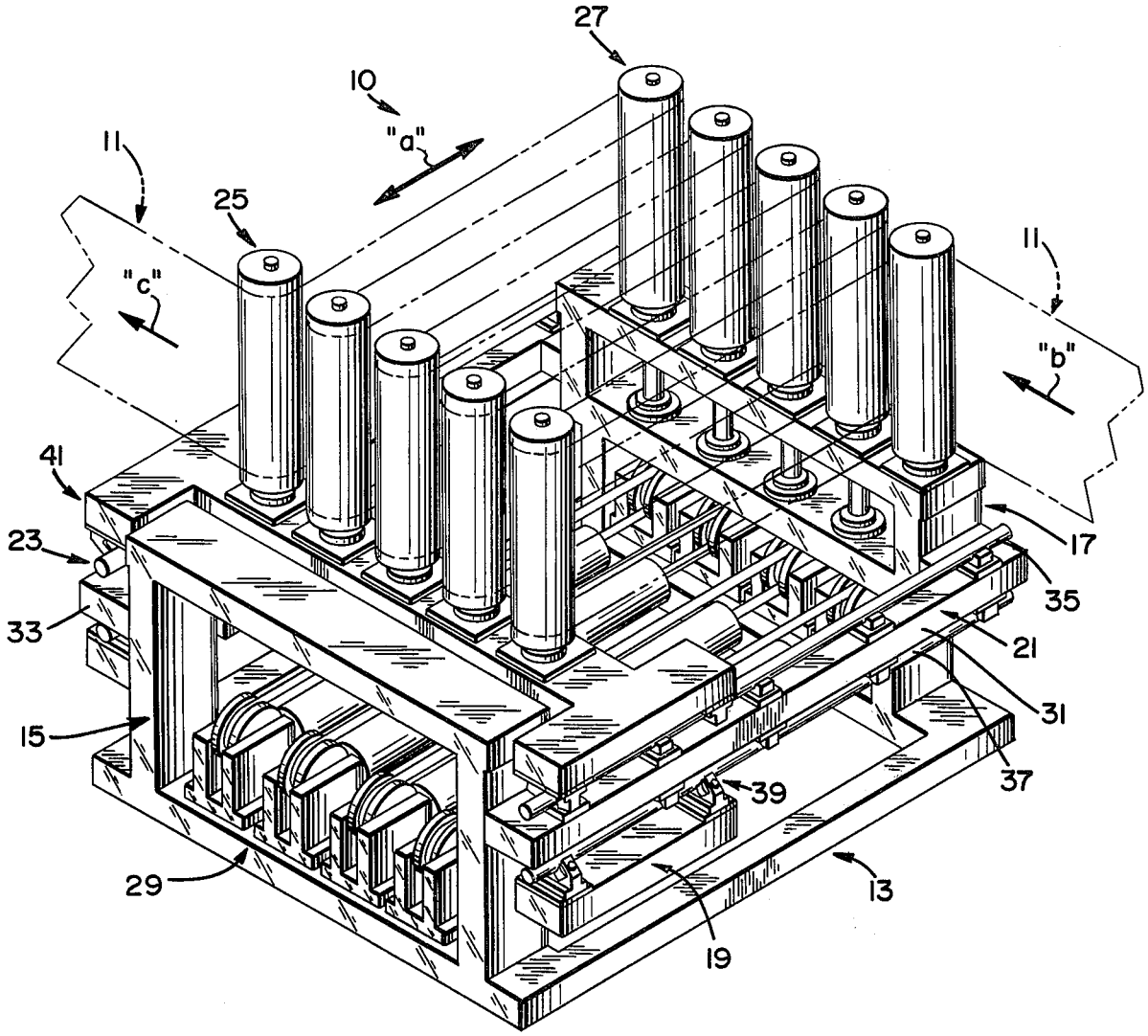
FIG. 1 is an isometric view of a preferred embodiment of the apparatus of the invention.

Referring now to the drawings with greater particularity, there is shown in FIG. 1 an apparatus 10 for maintaining a vertically oriented moving strip 11 (shown in phantom) of thin and flexible metallic material at a desired tension. In the production of color television aperture masks, it is essential that strip material 11, normally thin steel webbing approximately 26 inches wide and 0.006 inch thick, be maintained at said tension to prevent flexure, bending, or similar deformation thereof. As stated previously, a typical pulling force of approximately 1000 pounds is exerted on a strip of the size described above. It can be understood that any deformation to strip 11 would severely damage the strip and subsequently result in the rejection of any aperture mask or masks at the location of deformation.

Apparatus 10 comprises a frame 13 having first and second opposingly positioned upright members 15 and 17 respectively, a movable carriage 19, first and second substantially horizontally aligned guide means 21 and 23 respectively, first and second opposing series of vertically oriented rollers 25 and 27 respectively, and motion means 29 located below series of rollers 25 and 27 for imparting motion to carriage 19.

Figure 2:
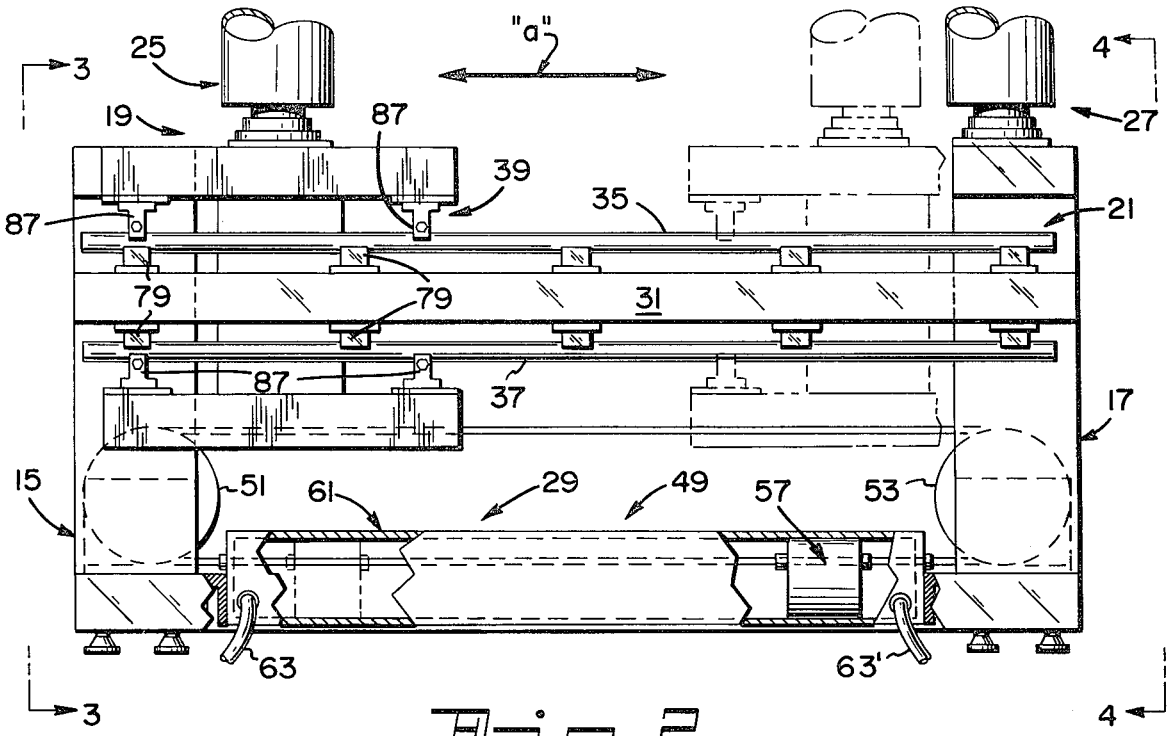
FIG. 2 is a side view of the apparatus of FIG. 1.

With reference to FIGS. 1 and 2, motion means 29 is adapted for imparting motion movable carriage 19 to accomplish reciprocative movement of carriage 19 in the direction ("*a*") shown. This direction is along a substantially horizontally aligned path when compared to the substantially vertically oriented metallic strip.

Guide means 21 and 23 are preferably substantially horizontally aligned and spacedly positioned on frame 13 in a substantially parallel relationship. As will be understood, the function of the guide means is to guide movable carriage 19 during the described reciprocative movement along horizontal path "*a*".

The first series of vertically oriented rollers 25 are positioned on movable carriage 19 and extend thereabove while the second series of rollers 27 are positioned on the stationary second upright member 17 of frame 13. Accordingly, each of these rollers engage strip 11 to effect circuitous movement of strip 11 therebetween. When producing aperture masks, it is understood that strip 11, as shown entering apparatus 10 from the right side of the drawing in FIG. 1 along the indicated direction "*b*", has just passed through the photosensitive coating station on the mask line. It is further understood that upon leaving apparatus 10 in the direction indicated by directional arrow "*c*", strip 11 now enters the photographic exposure station on the mask line whereby a desired photographic pattern will be exposed on the strip's coating (not shown).

In aperture mask production, the coating station on the mask line requires a substantially continuous movement of strip material 11. Conversely, the described photographic station requires an intermittent stopping of the coated mask in order to achieve the required exposure. It can therefore be understood that it is necessary to accumulate the moving strip for a predetermined time period between these described processes. It can further be seen that the highly flexible metallic strip having the photosensitive coating thereon must remain free of any possible contamination of said coating, said contamination adversely affecting the subsequent exposure process. The apparatus depicted in FIG. 1 overcomes any possibility of said contamination by positioning the vertically oriented series of rollers 25 and 27 above the remaining components of the apparatus, particularly the motion means 29. As will be described, apparatus 10 has substantially eliminated the possibility of any contaminants such as grease or oil from dropping from the motion means onto the coated strip 11.

Apparatus 10 preferably further includes first and second spacedly positioned brace members 31 and 33 which interconnect first and second upright members 15 and 17 of frame 13.

Figure 3:
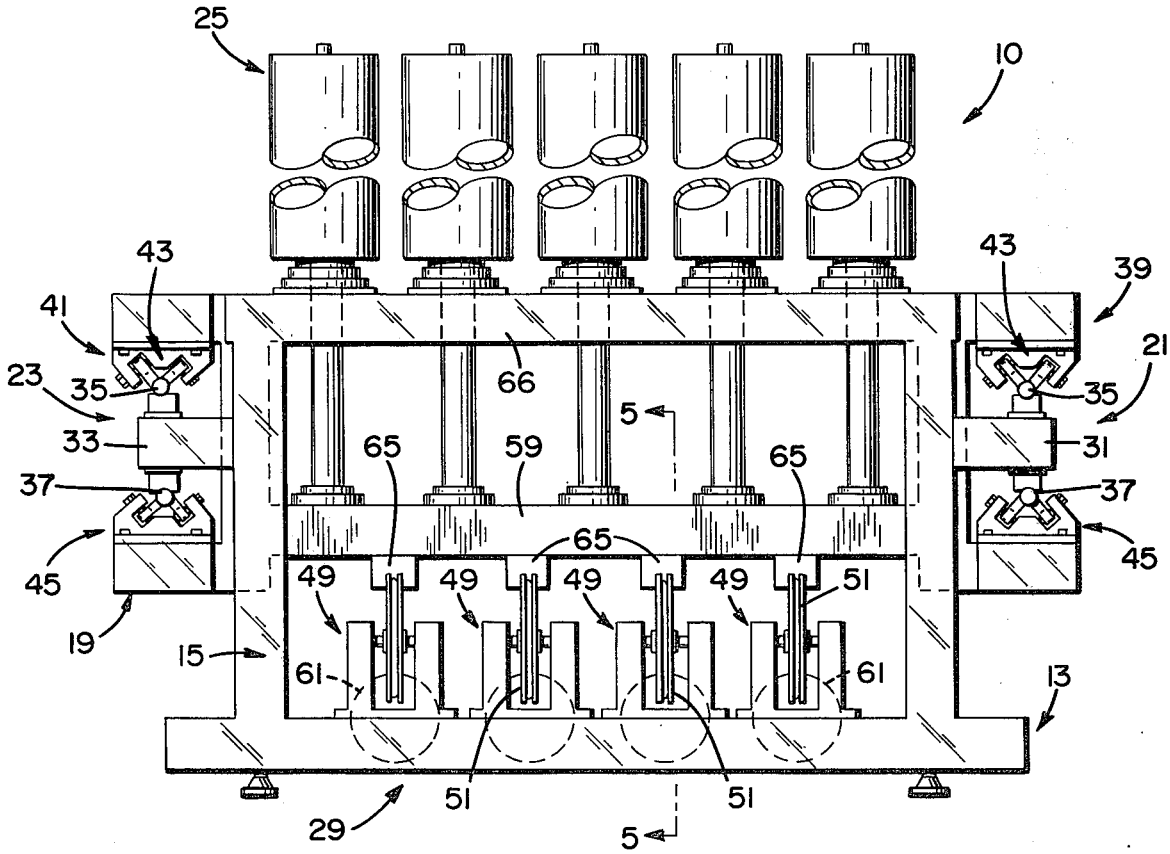
FIG. 3 is a front elevational view of the apparatus of FIG. 1 as taken along the line 3—3 in FIG. 2.

Guide means 21 and 23 each preferably comprise a pair of shaft members 35 and 37 securely positioned on opposing sides of brace members 31 and 33, respectively. As shown in FIG. 3, movable carriage 19 includes first and second rotational means 39 and 41 which are positioned on opposing sides of carriage 19 and are adapted for rotatably engaging shafts 35 and 37 of guide means 21 and 23, respectively, during the described reciprocative movement along path "*a*". With particular reference to FIG. 3, each of the rotational means 39 and 41 preferably comprise first and second pairs of bearing members 43 and 45, said first pair of bearing members 43 adapted for rotatably engaging upper shaft 35 of one of the guide means, said second pair of shaft members 45 rotatably engaging the lower shaft 37 of said guide means in an opposing manner to the first pair. It can be seen therefore that each side of movable carriage 19 is provided with at least a four-point engagement by the guide means of the present invention.

With reference to FIGS. 2–5, the preferred motion means 29 of the present invention is shown. Means 29 preferably comprises at least one pulley assembly 49 which includes first and second opposing stationarily positioned wheels 51 and 53, a substantially continuous wire 55 which rotatably engages wheels 51 and 53, and an hydraulically-actuated piston 57 which is secured to wire 55 and thus adapted for providing movement thereto. It can be seen in FIG. 5 that wire 55 is also affixed to a central brace member 59 (also shown in FIG. 3) of movable carriage 19. In the preferred embodiment of the invention, motion means 29 comprises four such pulley assemblies 49 spacedly located within apparatus 10 and thus spacedly affixed to brace 59 of movable carriage 19. Piston 57 is adapted for movement within a cylinder assembly 61 which in turn is secured to apparatus 10 at opposing ends thereof. That is, one end of cylinder 61 is affixed to upright member 15 of frame 13 while the opposing end of cylinder 61 is preferably affixed to second upright member 17 of the frame. As stated, the piston is moved by hydraulic action, the hydraulic medium being intermittently introduced into cylinder 61 through ports 63 and 63′ in accordance with a planned sequence of operation. The preferred hydraulic fluid medium is either oil or air although other mediums are acceptable. It is within the scope of the art to provide a suitable means for supplying fluid medium to cylinder 61 in the manner defined and thus further explanation is not considered necessary. Such a means could comprise a fluid pump, a reservoir of fluid, and various interconnecting lines to cylinder 61. Accordingly, actuation of said means to provide fluid in the desired manner can be accomplished manually or by an electronic circuit or similar means also considered well within the scope of the present art.

It is preferred in the present invention that each series of vertically oriented rollers 25 and 27 comprise a total of five such members. This is not meant to limit the broad aspect of the invention however in that other numerical combinations of rollers can be successfully used. It is also preferred that the number of rollers in each series be the same.

Figure 5:
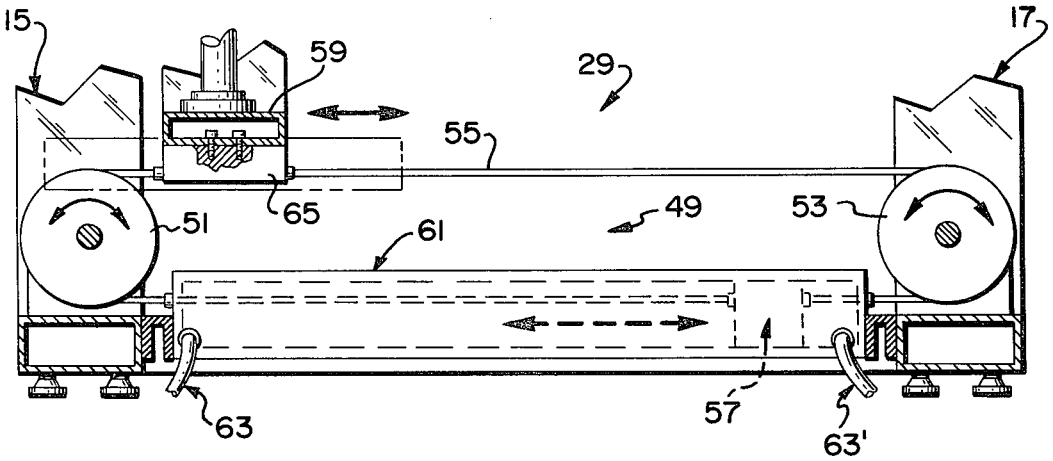
FIG. 5 is a side elevational view as taken along the line 5-5 in FIG. 3, depicting the preferred motion means of the present invention.

With particular reference to FIG. 5, it can be seen that the first stationarily positioned rotating wheels 51 of motion means 29 are preferably secured to first upright member 15 of frame 13. Additionally, it is preferred that second wheels 53 of motion means 29 be stationarily positioned on second upright member 17 of the frame.

Figure 4:
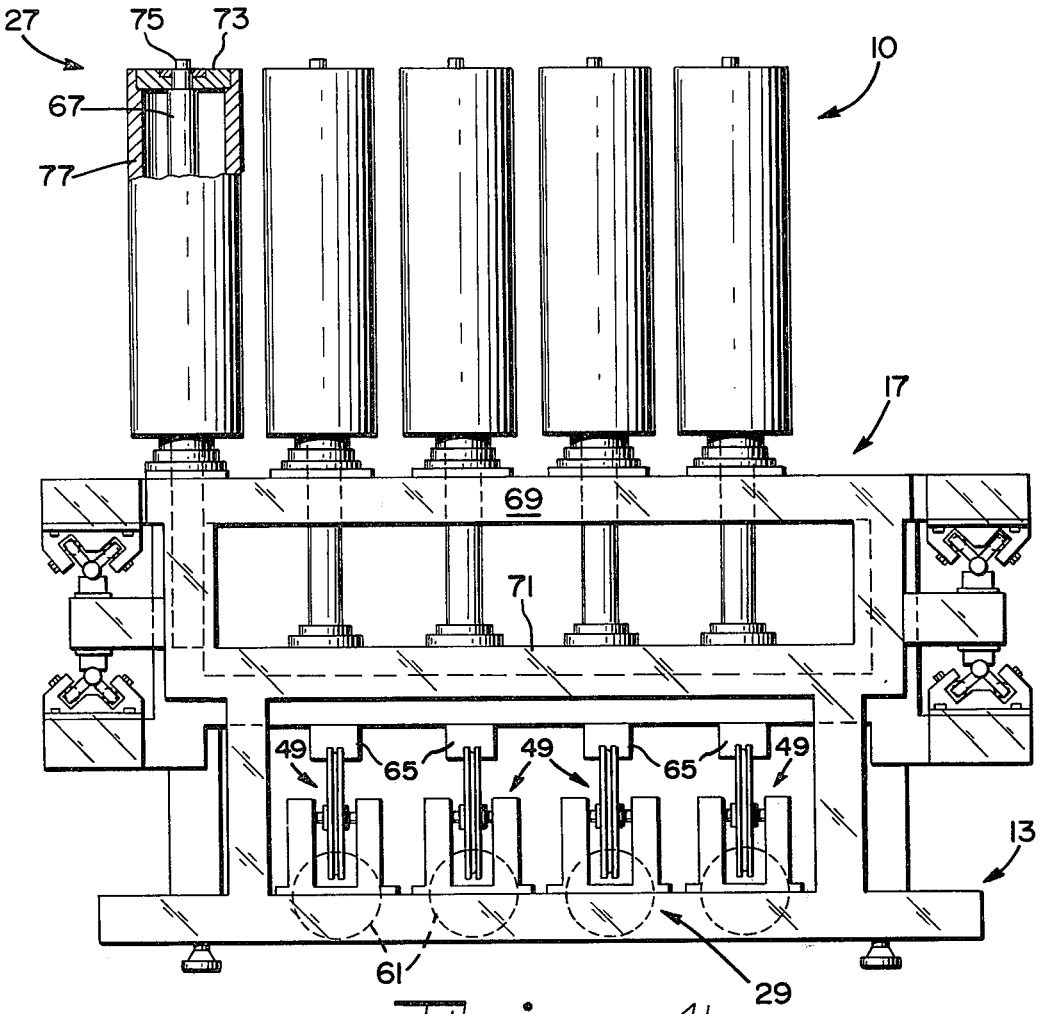
FIG. 4 is a rear elevational view of the apparatus of FIG. 1 as taken along the line 4—4 in FIG. 2.

FIG. 3 depicts a front end elevational view of apparatus 10, more clearly illustrating the various positioning relationships of the preferred four motion means 29. First stationary wheels 51 are shown secured in spaced adjacent relationship on first upright member 15 of frame 13. As previously stated, each of the wire members 55 of the pulley assemblies is affixed to movable carriage 59. This preferably accomplished by providing a corresponding number of tabular members 65 which extend below central brace 59 of carriage 19. These extending members are also illustrated in FIGS. 4 and 5. Each of the cylinder members 61 are also illustrated therein.

It should be noted that each of the first series of vertical rollers 25 extend through the upper cross brace 66 of movable carriage 19 and are securedly positioned in the lower brace 59 in the manner shown.

With particular regard to FIG. 4, the second series 27 of rollers are shown and are securedly positioned in a stationary manner within the second upright 17 of frame 13. FIG. 4, depicting a rear elevational view of apparatus 10, also illustrates the preferred positioning relationships for the various motion means 29 of the invention. It can be seen in FIG. 4 that the central shaft 67 of each of the rollers in series 27 extends through the upper brace arm 69 and are thus securedly positioned within the central brace arm 71 of upright 17. As stated, the preferred number of rollers in series 25 and 27 is five. It can be seen however, that series 27 is somewhat offset within apparatus 10 from that of series 25. This staggered relationship is better shown in FIG. 1 and is preferred to facilitate the circuitous movement of strip 11 through the apparatus.

Removal of each of the upright rollers of the present invention is facilitated by providing each of said rollers with a top cap member 73 (depicted in FIG. 4) which may be readily removed from central shaft 67. The cap member 73 is secured preferably by a nut 75 or similar member which locks the cap onto the outermost portions 77 of the cylindrical rollers.

Figure 6:
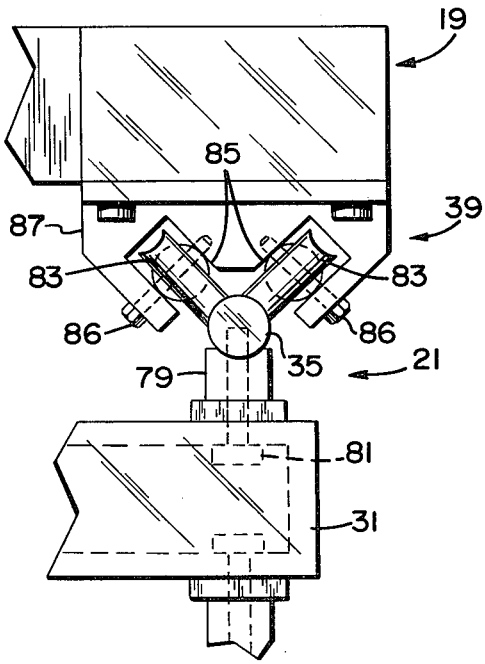
FIG. 6 is an enlarged end elevational view illustrating a portion of one of the preferred guide means of the invention.

FIG. 6 illustrates an enlarged end elevational view of a portion of the previously described guide means 21 of the present invention. Upper shaft 35 is shown as being securedly affixed to brace 31. This is accomplished by positioning shaft 35 on a supportive base member 79 and affixing the base and shaft 35 to brace 31 using an elongated retention screw 81. Screw 81 is threaded into shaft 35 a predetermined distance to prevent rotation of said shaft during movement of carriage 19. Engagement by the carriage's rotational means 39 is accomplished by providing means 39 with a plurality of angularly displaced roller bearings 83. Each of the bearings 83 are positioned about a central spherical ball 85 which in turn is secured to an extending bracket 87 of means 39 by a retention screw 86. It is understood that a similar arrangement is provided in the lower portion of means 39 for engaging the lower shaft 37 of guide means 21. It is further understood that similar components comprise the second rotational means 41 located on the opposing side of carriage 19 from means 39. As depicted in the drawings, each of the rotational means 39 and 41 of movable carriage 19 comprises at least four of the assemblies shown in FIG. 6. That is, the upper and lower portions of each side of carriage 19 is provided with at least two brackets 87, each of which contain the assembly depicted in FIG. 6. As further illustrated in FIG. 2, it is preferred that each of these assemblies be opposingly positioned in the manner indicated on the respective shafts 35 and 37 of the designated guide means. This positioning relationship will in turn prevent tipping or similar adverse movement of carriage 19 and series 25 of the rollers during the reciprocative movement.

Thus there has been shown and described an apparatus for maintaining a vertically moving strip of thin and flexible metallic material at an established tension in order to prevent deformation of this material. The apparatus as shown and described substantially eliminates the possibility of contamination of the strip or a coating thereon by strategically positioning the motion means and all of the other moving components of the apparatus below the series of rollers which engage the strip during the circuitous movement therebetween.

While there have been shown and described what are at present considered the preferred embodiments of the invention, it will be obvious to those skilled in the art that various changes and modifications may be made therein without departing from the scope of the invention as defined by the appended claims.

What is claimed is:

1. An apparatus for maintaining a vertically-oriented moving strip of relatively thin and flexible metallic material at an established tension to prevent deformation thereof, said apparatus comprising:

a frame having first and second opposingly positioned upright members and first and second spacedly positioned brace members, each of said brace members interconnecting said first and second upright members;

a movable carriage adapted for moving between said upright members in a reciprocative manner along a substantially horizontally aligned path;

first and second substantially horizontally aligned guide means spacedly positioned on said frame in a substantially parallel relationship for guiding said movable carriage during said reciprocative movement, each of said guide means comprising a pair of shaft members, said pair of shaft members of said first guide means secured to opposing sides of said first brace member of said frame, said pair of shaft members of said second guide means secured to opposing sides of said second brace member of said frame;

first and second opposing series of vertically-oriented rollers for positively engaging said moving metallic strip to effect circuitous movement of said metallic strip therebetween, said first series of rollers positioned on said movable carriage and extending thereabove, said second series of rollers positioned on said second upright member of said frame; and motion means located below said first and second series of rollers for imparting motion to said movable carriage to accomplish said reciprocative movement and maintain said metallic strip at said established tension.

2. The apparatus according to claim 1 wherein said movable carriage includes first and second rotational means positioned on opposing sides thereof, said first rotational means adapted for rotatably engaging said pair of shaft members of said first guide means, said second rotational means adapted for rotatably engaging said pair of shaft members of said second guide means.

3. The apparatus according to claim 2 wherein each of said rotational means comprises first and second pairs of bearing members, said first pair of bearing members adapted for rotatably engaging one of said shaft members of said guide means, said second pair of bearing members adapted for rotatably engaging the other shaft member of said guide means.

4. The apparatus according to claim 1 wherein said motion means for imparting motion to said movable carriage comprises at least one pulley assembly including first and second opposing stationarily positioned wheels, a substantially continuous wire rotatably engaging each of said wheels and affixed to said movable carriage, and an hydraulically-actuated piston secured to said wire and adapted for providing movement thereto.

5. The apparatus according to claim 4 wherein said first wheel of said pulley means is securedly positioned to said first upright member of said frame and said second wheel of said pulley means is securedly positioned to said second upright member of said frame.

6. The apparatus according to claim 4 wherein said motion means comprises four of said pulley assemblies.

7. The apparatus according to claim 1 wherein the number of rollers in each of said series of vertically oriented roller is five.

* * * * *

UNITED STATES PATENT AND TRADEMARK OFFICE

CERTIFICATE OF CORRECTION

PATENT NO. : 4,009,815

DATED : March 1, 1977

INVENTOR(S) : Ivan L. Ericson and James E. Morean

It is certified that error appears in the above-identified patent and that said Letters Patent are hereby corrected as shown below:

Col. 2, line 60 - After "motion" and before "movable", please insert -- to --.

Signed and Sealed this

*nineteenth* Day of *July 1977*

[SEAL]

*Attest:*

RUTH C. MASON
*Attesting Officer*

C. MARSHALL DANN
*Commissioner of Patents and Trademarks*